US005187968A

United States Patent [19]

Beetz et al.

[11] Patent Number: 5,187,968

[45] Date of Patent: Feb. 23, 1993

[54] CRIMP TOOL FOR PRESSING END SLEEVES FOR STRANDS

[75] Inventors: Horst Beetz, Stadtallendorf; Kurt Battenfeld, Ebsdorfergrund, both of Fed. Rep. of Germany

[73] Assignee: WEZAG GmbH Werkzeugfabrik, Stadtallendorf, Fed. Rep. of Germany

[21] Appl. No.: 791,581

[22] Filed: Nov. 12, 1991

[30] Foreign Application Priority Data

Dec. 11, 1990 [DE] Fed. Rep. of Germany ..... 4039435

[51] Int. Cl.[5] ..... H01R 43/042

[52] U.S. Cl. ..... 72/410; 72/416; 29/751; 81/418

[58] Field of Search ..... 72/410, 409, 416, 412; 29/751, 753; 81/418–421, 427

[56] References Cited

U.S. PATENT DOCUMENTS

| | | | |
|---|---|---|---|
| 2,743,634 | 5/1956 | Badeau | 81/15 |
| 3,028,628 | 4/1962 | Rutherford | 72/409 |
| 3,531,971 | 10/1970 | Robb | 72/410 |
| 3,571,888 | 3/1971 | DiFilippo | 29/751 |
| 3,706,219 | 12/1972 | Hoffman | 72/410 |

FOREIGN PATENT DOCUMENTS

| | | | |
|---|---|---|---|
| 1615651 | 5/1970 | Fed. Rep. of Germany . | |
| 2149167 | 5/1973 | Fed. Rep. of Germany . | |
| 4039435 | 6/1992 | Fed. Rep. of Germany . | |
| 657559 | 9/1986 | Switzerland | 72/410 |

*Primary Examiner*—Daniel C. Crane
*Attorney, Agent, or Firm*—Hopkins & Thomas

[57] ABSTRACT

A crimp tool for pressing the end sleeves of strands with a pair of jaws (1, 2) held in a pivot bearing (5) and swivellable about the pivot bearing by means of a drive (9) acting upon the driver ends of each jaw (1, 2). A cheek plate (20, 21) is connected to each of the clamp ends of the jaws (1, 2), and is movable into a first pressing position (17) for universally covering a range of cross-sectional areas of end sleeves (19). The jaws (1, 2) each include a rigid area (7) and a resilient area (8). A first stop (26) and counter-stop (27) are connected between the cheek plates (20, 21) and the resilient area (8) of each jaw (1, 2) and a second stop (28) and counter-stop (29) between the cheek plate and the rigid area (7) of each jaw (1, 2). The first stops (26) and counter-stops (27) are dimensioned to engage one another during crimping, and the second stops (28) and counter-stop (29) come to engage one another during crimping only during crimping of end sleeves having the maximum cross-sectional area that can be received between the cheek plates (20, 21) of the jaws (1, 2).

10 Claims, 6 Drawing Sheets

CRIMP TOOL FOR PRESSING END SLEEVES FOR STRANDS

FIELD OF THE INVENTION

The invention relates to a crimp tool for pressing end sleeves for strands, said tool comprising two jaws held in a pivot bearing and being swivellable about the pivot bearing by means of a drive comprising two hand levers, whereby each jaw is provided with a spring jaw, and the drive acts upon the one end of said jaws and a cheek plate is connected to each of the other ends of said jaws, said cheek plate universally covering a cross-sectional area being determined as the pressing position.

BACKGROUND OF THE INVENTION

For the purpose of equipping strands of electric cables that are ready to connect it is known to place end sleeves on the skinned strand encompassing the wires of the strand and then to press the end sleeve in such a manner that said sleeve is given a rigid, immobile seat. The connection of the strand is then made through a screw connection at the connecting position, said screw connection pressing on the pressed end sleeve. The end sleeves have a circular cross section in the unpressed condition. In accordance with DIN standards it is provided that after the pressing the sleeve should have a trapezoidal cross section in order to achieve a particularly tight connection between the end sleeve and the strand.

A crimp tool of the type mentioned above, which can be universally used for cross-sectional areas between 0.5 and 4.0 mm, is arranged in accordance with the principle of scissors, i.e. each of the jaws forms one part with the handle and the two parts are connected to each other by means of an axle journal. The two cheek plates are flexibly suspended in the jaws and guided against each other and form a pressing position whose axis lies in the main extension plane of the crimp tool, whereby the pressing can be made with said tool either at the front end or head end. The resilience for overcoming the differences in the path is achieved in this tool in such a way that the jaws each comprise in the centre a recess with an open edge extending from the flexible pivot bearing in the direction towards the handles, whereby the axle journal is arranged in the area of said jaws. The jaws thus form spring jaws or yielding springs. The frontal arrangement of the pressing position is preferable here. There is the disadvantage, however, that because of the arrangement of the handles and the jaws in one single piece only a simple lever transmission of the drive is possible, so that the crimp tool requires relatively high pressing forces. In addition, the described resilient or flexible arrangement of the jaws and their load may lead to material fatigue. The spring forces supplied by the jaws are, in addition, highly dependent on the adherence to narrow tolerances of the cross sections of the jaws. A change in the material thickness or even a deviation in the predefined hardness will change the elasticity properties of the tool, so that no reproduceable results can be expected for the respective tolerances. If an end sleeve with a larger cross section than the maximally provided cross section is inserted and pressed, there is the danger that the resiliently arranged jaws are subjected to plastic deformation, so that the crimp tool can no longer be used in the proper manner.

A further crimp tool arranged as a universal crimp tool comprises two cheek plates with only a single pressing position, i.e. a single mould for deforming strands of varying thickness. The universal pliers can press strands with a cross section between 0.5 to 4.0 mm. When pressing strands with a small cross section, for example 0.5 mm, the cheek plates close fully or nearly fully at the time at which the drive has covered its maximal path, e.g. when the handles are pressed together at a maximum. When pressing larger cross sections, for example 4.0 mm, the pressing position remains relatively open, i.e. the cheek plates must end their path earlier by including the material of the strand, whereas otherwise the drive always covers an identical path in all cases. In order to compensate the differences in the path this tool also comprises a flexible pivot bearing on the jaws of the crimp tool. The one jaw is rigidly connected to the handle, i.e. they are made of one single piece. A bent lever acts upon the other jaw as drive, said drive being actuated by means of the other handle. The two jaws are swivellably held about an axle journal in the manner of a rocking lever. The jaw driven by the bent lever drive is exclusively swivellably held on the axle journal by means of a cylindrical bore, whereas the other jaw embraces the axle journal with an oblong hole which is arranged in the jaw parallel to the direction of movement of the cheek plates during the pressing. In the jaw forming a part with the handle a horseshoe-like yielding spring is swivellably suspended in a hinge pin, whose other end acts upon the axle journal of the two jaws. When pressing cross sections of varying thickness the yielding spring allows the one jaw to yield relative to the other jaw and thus the one cheek plate relative to the other plate, although the identical path is covered with the drive in the jaws. The cross-sectional ranges that can be pressed are limited to cross sections between 0.5 and 4.0 mm. Preferable in this crimp tool is the arrangement of the cheek plates, which allow the insertion of the end of the strand and the end sleeve transversally to the main extension plane of the crimp tool, so that the conicalness of the pressed end sleeves is prevented. The relative arrangement of the pressing position is disavantageous with respect to the fact that, for example, difficulties could arise in cramped switch cabinets. The horseshoe-like yielding spring, which is provided in double arrangement and in allocation to the one jaw, is subjected to considerable wear and tear by pressing larger cross sections, that there is the danger of material fatigue. The cheek plates are arranged on the jaws, but are not swivellable with respect to said jaws, so that the cheek plates assume the scissors -movement of the jaws even during the closing process. This scissors movement leads to the formation of flaps on one side during the pressing, i.e. the pressed cross section does not have a symmetrical form.

A further known universal crimp tool comprises a jaw driven through a bent lever drive. The one jaw is parted towards the handle, whereby a plastic block is arranged in a cuboid casing, said block being compressible through an end plate arranged on the handle, so that the required path differences on the cheek plates are achieved in such a way. The two cheek plates are swivellably held on a common axle journal without the arrangement of an oblong hole. The swivellability of the parted jaw is limited between stops, so that there are limits in the compression of the plastic block. The cheek plates are flexibly suspended on the jaws and guided against each other, whereby they engage with each other in a comb-like manner and form a pressing position having an approximately square outline, whereby the axis of said pressing position lies in the main extension plane or direction of the tool. This arrangement is beneficial for the use of the crimp tool in cramped conditions, e.g. in a switch cabinet. It is furthermore preferable that this tool can process a larger cross-sectional area between 0.5 to 6.0 mm. The disadvantage consists of the fact, however, that the pressing cross section is not equivalent to the desired trapezoidal cross section, but approximately square. By the respective arrangement of the cheek plates the pressing is carried out in each plane transversal to the axis of the strand only on two opposite positions or surface areas, whereas the two other surface areas which are displaced by approx. 90° sag freely and can thus deform against the pressing power acting upon them. The form produced by the pressing is thus not optimal and does not fulfill DIN standards. Furthermore, the disadvantage arises that the pressed end sleeves have a slightly conical form, in particular in the event that comparably short end sleeves are used which cannot be inserted into the pressing position symmetrically to the hinge points of the cheek plates. This conicalness tapers precisely in the direction in which the end sleeve can be pulled out from its connecting position, so that there is the danger that in the event of the loosening of the screw connection or the movement of the strand the screw connection comes undone.

From the DE-AS 21 49 167 a crimp tool is known with which it is possible to optionally press different cross sections. However, a special pressing position is provided in the cheek plate for each cross section, so that the tool does not concern a universal crimp tool. In this known crimp tool there is the danger that the pressing positions are confused, so that the pressing takes place at the wrong pressing position. In addition, it needs additional handling next to the necessary special attention.

SUMMARY OF THE INVENTION

The invention starts out from the problem to further develop a universal crimp tool of the kind mentioned above, in which the spring jaw or spring jaws are protected from overstressing and nevertheless allow the proper pressing of comparably large cross-sectional areas of strands with end sleeves.

In accordance with the invention this is achieved in that at least one of the jaws comprises two areas acting upon the cheek plates, of which the one area is arranged substantially rigid and the other area is arranged as spring jaw in a yielding and springy manner, and that at least the one of the cheek plates is guided on one of the areas of the jaw in the direction of movement of the cheek plates, and that between the cheek plate and the resilient area of the jaw a first stop and counterstop are provided and that between the cheek plate and the rigid zone of the jaw a second stop and a counterstop are provided, and that the distance between the two stops with respect to the distance between the two counterstops is dimensioned in such a way that during the crimping at first the first stop and the counterstop come to sit close with full effect in the substantial cross-sectional area and that the second stop and the counterstop come to sit close with one another with full effect only in the area of the maximum cross section. It is sufficient that at least one of the jaws comprises two areas acting upon the cheek plates. Generally, however, a symmetrical arrangement is to be preferred, so that both jaws should each comprise a substantially rigidly arranged area and a substantially resiliently and yieldingly arranged area. By providing a respective dimension of the cross section and by the respective arrangement it is possible to design the two areas according to their respective functional purpose. It is important that both areas, even if at different times, reach the cheek plates for sitting close to said cheek plates with full effect. In the substantial, covered cross-sectional area, starting out from the minimal cross section of the strand up to the area of large cross sections, the force required for deforming the end sleeve and the strand is solely transmitted by the resiliently arranged areas jaws onto the cheek plates. The first stop in the cheek plate and the first counterstop in the resilient area of the jaw sit close to one another over the covered cross-sectional area of the strand at least in the pressing positions, i.e. there is an effective connection, so that the pressing forces can be transmitted here. At the same time a spring movement between the resilient area and the rigid area of the jaw takes place. In the area of a maximal cross section of a strand to be pressed, which may also cover a certain, even small area, the second stop comes to sit close to the cheek plate with full effect and the second counterstop comes to sit close to the rigid area of the jaw with full effect, so that additional pressing power is transmitted to the cheek plates through the rigid areas. Said additional pressing power adds itself to the force that can maximally be transmitted by the resilient areas. In other words, the pressing force required by the resilient area is limited to a maximum value, so that the yieldingly arranged areas of the jaws are protected from overstressing and thus from plastic deformation which could occur by said overstressing. Whereas in the generic state of the art the overall jaw is arranged and acts as spring jaw, the subject matter of the application creates two areas in the jaw, i.e., on the one hand, a substantially rigid area and, on the other hand, a substantially resiliently and yieldingly arranged other area, which are clearly separated from one another with respect to their function. Hence, a yielding spring is virtually formed on the rigid jaw.

The new crimp tool allows pressing cross-sectional ranges of strands between 0.25 and 6.0 $mm^2$. This range is comparably higher than in known crimp tools of the state of the art. The principal arrangement of the new crimp tool becomes particularly useful in connection with a double lever drive, whereby the drive comprises a double transmission, which, on the one hand, proves beneficial to the short constructional length of the tool and, on the other hand, allows exerting the considerable pressing forces required for pressing large cross sections of strands. The short length also facilitates the handling of the crimp tool, so that it can also be used in cramped conditions, e.g. in switch cabinets and the like. The new crimp tool allows, without any additional measures, the preferable frontal arrangement of the pressing position, so that the strand with the inserted end sleeves can be inserted into the pressing position either from the front side or head side, i.e. in the direction of the main extension of the crimp tool. In the double lever drive the handles and the jaws are different parts, i.e. they are not made from one single piece, so that there is the preferable option to use material of higher comparable quality in order to fulfill the requirements caused by the stress exerted on the areas of the jaws. The total compressible cross-sectional area exceeds the elasticity range in the event of the compressibility of an additional maximum cross section or a small cross-sectional area. Nevertheless the resiliently arranged areas of the jaws are protected from overstressing even in the event of such pressings. As the jaws with its rigid areas and its resilient areas are made from one piece, the new crimp tool also only has a small number of single components, which has a beneficial effect on the manufacturing and assembly costs.

The area of the jaw serving as spring jaw can sit close to the first stop of the cheek plate with its first counterstop. This means that at least in the pressing position for the smallest cross section of the strand, and also if the crimp tool is in the opened position, the first counterstop and the first stop already sit close to one another, whereby the resilient area of the jaw is already subject to an initial tension by means of this pair of stops and said initial tension is picked up by the rigid area of the jaw. When the crimp tool has assumed the pressing position for the smallest cross section of the strand, the pressing force is no longer exerted in full or in part from the resilient area to the rigid area, but to the end sleeve for the strand. The exertion of the initial tension is essential, because sufficiently high pressing forces are provided even for very small cross sections of the strand, i.e. such forces that are required for the proper pressing. The closing position of the crimp tool is provided with higher pressing forces in the event of small cross sections than in tools in which the resilient areas act upon the cheek plates without initial tension.

The jaw with its two areas can suitably be provided in one piece, whereby the two areas are formed by a slot having an open edge on the lateral side and extending substantially parallel to the main extension direction of the crimp tool. The provision of a slot and the design allow arranging the jaws in such a way that they are able to fulfill their various requirements in a optimal manner. The two areas comprise a respective handle length, so that they are able to transmit the desired forces.

It is particularly preferable if the slot, starting at the head end of the jaw, extends in the area of the cheek plate beyond the pivot bearing of the two jaws. In contrast to the state of the art, the pivot bearing is not arranged resiliently, but comprises an axle journal in which the two jaws are only swivellably suspended and supported with their rigid areas. As the slot can be arranged longer than the distance between the axle realizing the pivot bearing and the suspension position of the cheek plates, the rigid area of the jaw preferably comprises a small lever arm and the resilient area of the jaw preferably comprises a larger lever arm, so that despite the cramped design of the crimp tool, respectively long pitches of spring are provided. These large pitches of spring are required to cover the comparably large cross-sectional areas of strands.

Preferably the jaws may consist of four plates in a plate design, whereby the rigid areas are arranged on the inside and the resilient areas are arranged on the outside. The resilient areas can be bent upwardly and downwardly from the plane of the rigid areas. This arrangement is matched to the outline of the cheek plates in a particular manner and allows arranging the rigid areas of the jaws in a space-saving manner practically in the outline of the cheek plates and the resilient areas of the jaws outside of this outline. This results, amongst other things, in an attractive design of the head of the crimp tool. The bending of the resilient areas out of the main extension plane of the tool and the provision of a total of four plates nevertheless leads to a symmetrical design with respect to the main extension plane.

For the realization and the arrangement of the rigid and the resilient areas of the jaws and the guidance of the cheek plates in parts of said jaws there are various options for the man skilled in the art. Thus the cheek plates can optionally be guided in the rigid or resilient areas of the jaws, whereby said guidance usually only refers to a sliding guidance in the direction of movement of the cheek plates. It is possible to arrange the rigid areas of the jaws showing towards each other comparatively on the inside and the resilient areas of the jaws comparatively on the outside. This is preferable insofar as the axle journal for the unyielding pivot bearing can be arranged in the rigid areas of the jaws without any additional measures. A single axle journal is sufficient. Principally it is also possible to arrange the resilient areas of the jaws on the inside and the rigid areas of the jaws comparatively on the outside. In this event it is recommended to realize the pivot bearing by using two axle journals and a connecting bridge.

A preferable embodiment consists of guiding the cheek plates with oblong holes in the direction of the movement of said cheek plates in the rigid areas of the jaws. On the one hand, said oblong holes enable the required movement of the spring and, on the other hand, constitute stops at their ends in order to limit said movement, enable the initial tension and protect the resilient areas from overstressing.

The drive of the jaws is suitably arranged as double lever drive to enable, on the one hand, a compact design and, on the other hand, to provide nevertheless the high pressing forces in the extended cross-sectional area for strands with large cross sections.

The two cheek plates can be suspended in the rigid areas of the jaws on bolts extending transversally to the main extension plane of the crimp tool and guided against each other, whereby the pressing position is arranged in such a manner as to allow the frontal insertion of the end sleeves in the main extension plane. The cheek plates are thus not only guided by bolts, but also comprise surfaces with which they guide and support each other directly, so that despite the bolts and the inserted oblong holes the jaws do not carry out any considerable swivelling movement, but carry out a translational movement in their direction of movement during the pressing process. The guidance against each other in the area of the cheek plates prevents, to a large extent, the conical shape of the pressed end sleeves.

On the other hand, the cheek plates may also be suspended in the resilient areas of the jaws. This enables a particularly slender design. The jaws and the cheek plates can be arranged in a casing which is open on the head side.

The cheek plates can have such an outline in the area where the resilient areas of the jaws sit close to one another that the initial tension is exerted or increased only during the closure of the crimp tool. It is important that the initial tension is available to the desired extent at the end of the closing process, namely in relatively thin strands, i.e. in the lower cross-sectional range. In the open position of the tool the initial tension should preferably not be present or only be relatively small, in order to facilitate the assembly of the tool. A second reason is due to the fact that the resilient areas of the jaw with respect to the outer outline of the cheek plates, to which said resilient areas sit close, move easily during the closing and the opening of the crimp tool, i.e. that the stops and bearing points travel. Thus a frictional force has to be overcome which is so much the larger the larger the acting initial tension is. When opening the tool, a retracting spring, for example, acting about the joint axis of the handle lever must be dimensioned in such a way that the mentioned frictional force has to be overcome and that thus the crimp tool is automatically brought back to the opening position after a crimping process. In order to avoid having to dimension the retracting spring too strong, it is recommendable to arrange the movement geometry in such a way that the initial tension in the open position of the tool, i.e. when the retracting spring also is expanded and provides a relatively low retracting force, is relatively small or completely neutralized. In contrast to this, a high initial tension in the closing position or in positions adjacent to the closing position does not cause any disturbance, because the retracting spring is also pressed together fairly strongly in such positions and thus provides an increased retracting force. The retracting spring must be dimensioned in such a way that it provides in all positions a higher opening momentum than that equivalent to the frictional force which has to be overcome and which was caused by the respective initial tension between the resilient area 8 and the outline of the cheek plates 20 and 21.

BRIEF DESCRIPTION OF THE DRAWINGS

Embodiments of the invention are represented in the drawings and are described below, in which.

DETAILED DESCRIPTION

Figure 1:
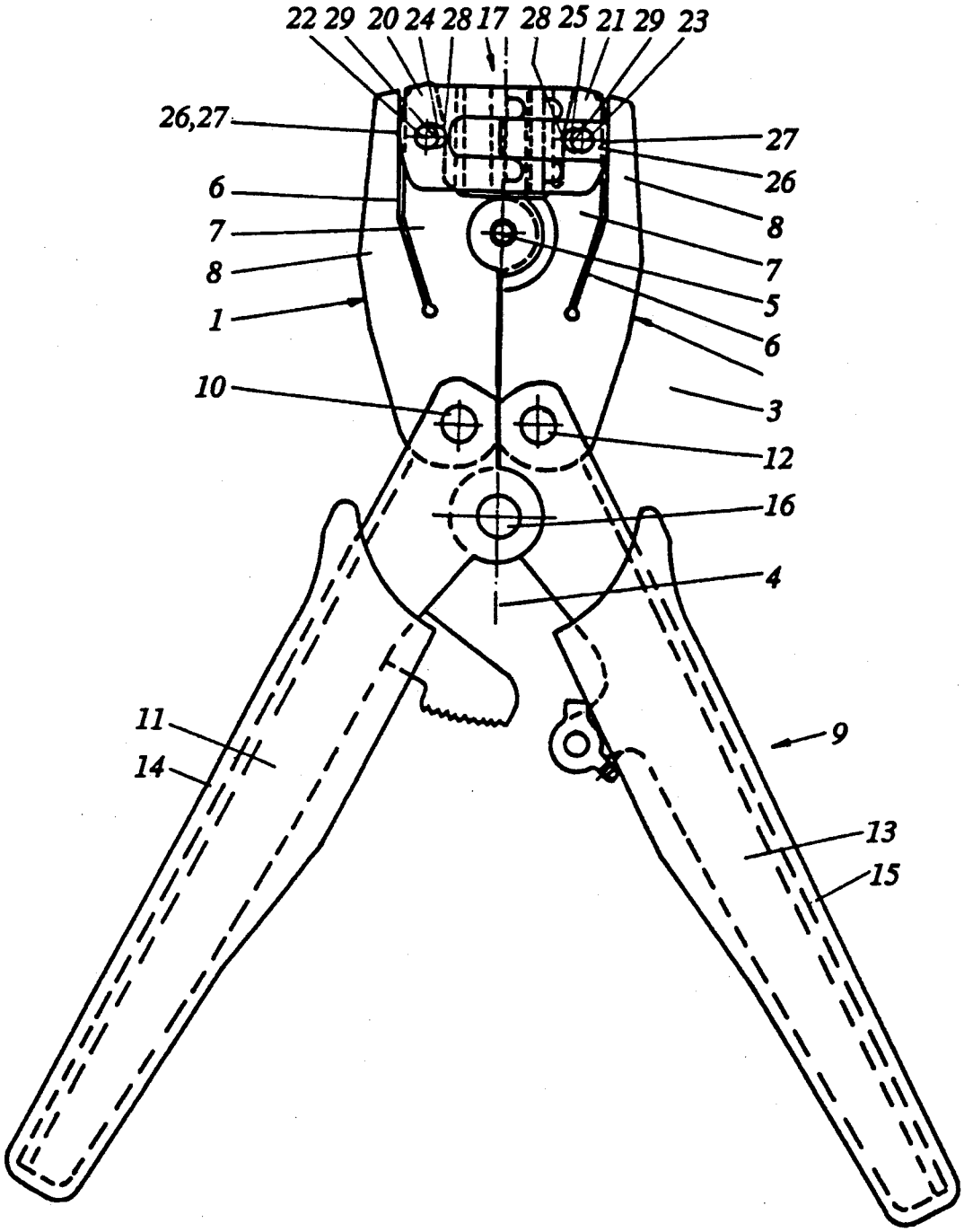
FIG. 1 shows a top view of a first embodiment of the universal crimp tool in the open position.

Essential components of the crimp tool are the two jaws 1 and 2, which are arranged and disposed substantially symmetrically, on the one hand in the main extension plane 3, which forms the drawing plane in FIG. 1, and, on the other hand, there is a substantially symmetrical arrangement with respect to the vertical median plane 4 extending vertically to the main extension plane 3. The two jaws 1, 2 are arranged in the manner of rocking levers and are held in an axle journal 5 swivellably moveable, but not resilient. As the jaws 1 and 2 must encompass each other in this area, the arrangement deviating from the symmetrical arrangement is limited to the said area. In principle, however, jaws 1 and 2 are arranged symmetrically, whereby it is understood that also an asymmetrical arrangement would be possible.

Each jaw 1 or 2 (see also FIG. 3) is divided by a slot 6 comprising an open edge on the lateral side and extending into an area 7 which is substantially rigid and a resilient springy area 8 which can also be termed a spring jaw. If a jaw known in accordance with the prevailing state of the art is regarded as a rigid component, a spring jaw is practically formed on such a rigid jaw.

A drive 9 acts on the rear ends of the jaws 1 and 2 for providing the required swivelling movement of said jaws 1 and 2. For this purpose a handle 11 is swivellably pivoted on the jaw 1 by means of an axle journal 10. In a symmetrical arrangement the handle 13 acts on jaw 2 through an axle journal 12. The two handles 11 and 13 are arranged as metal moulding parts and they are each coated by a plastic coating 14, 15. The two handles 11 and 13 are swivellably pivoted with respect to each other about a common pivot journal 16. The swivelling takes place in such a way that when handles 11 and 13 are pressed together, the axle journals 10 and 12 travel or move away from each other, so that finally the jaws 1 and 2 are swivelled towards each other at their other frontal ends. As can be seen, this arrangement forms a double lever drive.

At the front ends of jaws 1 and 2 a pressing position 17 is formed into which the skinned end of a strand 18 (FIG. 4) with a superimposed end sleeve 19 can be inserted from the frontal side into the pressing position in the direction parallel to the direction of the intersection line between the main extension plane 3 and the vertical median plane 4. The pressing position 17 is formed by two cheek plates 20 and 21, whereby the cheek plate 20 is suspended on a bolt 22 arranged in the rigid area 7 of jaw 1 (see FIG. 4). Similarly, the cheek plate 21 is suspended on and guided by a bolt 23 at the front end of the rigid area 7 of the jaw 2. In addition, the cheek plates 20 and 21 are guided against one another, so that despite the substantially rotary movement of the bolts 22 and 23 they carry out a substantially translational movement.

The cheek plate 20 comprises an oblong hole 24 around the bolt 22, said bolt being arranged in the rigid area 7 of the jaw 1. Similarly, cheek plate 21 comprises an oblong hole 25. The resilient areas 8 of the jaws 1 and 2, which are arranged on the outside as compared to the rigid areas 7, sit close to the cheek plates 20 or 21 from the outside, whereby a first stop 26 on cheek plate 20 or 21 sits close to the first counterstop 27 with full effect or at least comes to sit close with full effect in the pressing position of the crimp tool. The first stops 26 are provided on the cheek plates 20 and 21. The first counterstops are provided on the resilient areas 8 of jaws 1 and 2. Two further stops 28 are provided on the cheek plates 20 and 21, said stops being formed by the inner ends of the oblong holes 24 and 25. To said second stops belong the second counterstops 29, which are provided in the rigid areas 7 of jaws 1 and 2 and which are formed here by the bolts 22 and 23. FIG. 1 shows that the first pair of stops 26, 27 sits close, whereas in the second pair of stops the stops 28 are at a distance from the respective counterstops 29. Said distance is equivalent to the provided pitch of movement of the bolts 22 or 23 in the oblong holes 24 or 25. The resilient areas 8 of jaws 1 and 2 sit close to the cheek plates 20 and 21 under the exertion of an initial tension, whereby said initial tension transmitted by the pair of stops 26 and 27 rests on the bolts 22 and 23 and on the areas of the oblong holes 24 and 25, which constitute the other end of said oblong holes 24 and 25 as compared to the stops 28. This already shows that the cheek plates 20 and 21 are guided towards each other or away from each other on the bolts 22 and 23 by means of the oblong holes 24 and 25 only in the direction of movement of said cheek plates 20 and 21.

Figure 2:
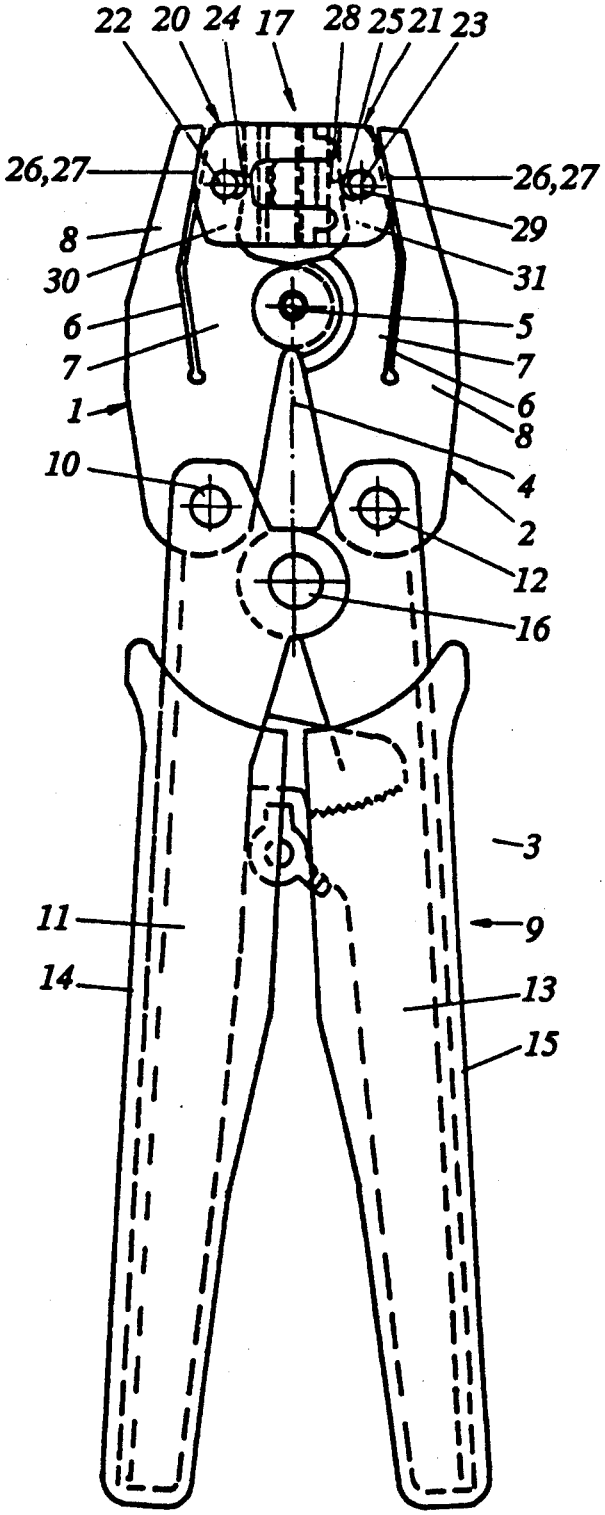
FIG. 2 shows a top view on the crimp tool in accordance with FIG. 1 in the closed position.

FIG. 2 shows the crimp tool in the closed position without, however, a wire inserted into the pressing position 17. In contrast to FIG. 1 it can be seen that due to the swivelling of the handles 11 and 13 towards each other the two axle journals 10 and 12 have travelled away from one another, so that the jaws 1 and 2 have carried out a respective swivelling movement about the joint axle journal 5. The cheek plates 20 and 21 are moved towards each other until they have the smallest possible distance from one another. The closing force is transmitted through the pair of stops 26, 27. The resilient areas 8 of the jaws 1 and 2 still sit close to the cheek plates 20 and 21. Apart from a slight rotary movement, the bolts 22 and 23 still sit close to the same side of the oblong holes 24 and 25, as is shown in the open position in accordance with FIG. 1. In this movement, however, the two cheek plates were guided towards the bolts 22 and 23, so that they carried out a translational movement towards each other by means of their own support against each other, as is shown in FIG. 2 in the end position.

In the drawings, in particular in FIGS. 1 and 2, a known detent means is shown in the region between the handles 11 and 13, said means ensuring that the crimp tool can only be opened again after having properly reached the closing position. This defines, at least between the handles 11 and 13, an identical closing position for all cross-sectional ranges, so that in the event of different cross sections to be pressed and the resulting different paths between the resilient areas 8 in connection with the respective end position of the cheek plates 20 and 21 towards each other varying pressing and deformation forces are provided, which are required for the different cross sections.

Figure 3:
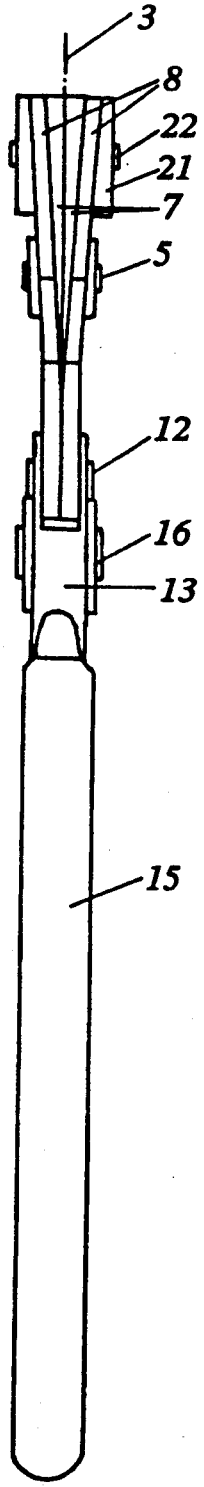
FIG. 3 shows a side view of the crimp tool in accordance with FIGS. 1 and 2.

FIG. 3 shows the particular shape of the resilient areas 8 relative to the rigid areas 7. The two cheek plates 20 and 21 each comprise a recess 30, 31 (FIG. 6) on their outside, in which the rigid areas 7 of the jaws 1 and 2 come to rest. The resilient areas 8 are now bent out from the main extension plane 3, so that they sit close to the cheek plates 20, 21, namely on the stops 26 formed therein.

FIG. 4 explains again the particular single arrangement of the jaws by means of the example of jaw 1 and the suspension belonging to cheek plate 20. This FIG. shows that the first stop 26 sits close effectively against cheek plate 20 and the first counterstop sits close effectively against the resilient area 8 of the cheek plate 1, whereas the second stop 28 sitting close to the cheek plate 20 still is at a respective distance from the second counterstop 29 in the rigid area 7 of jaw 1. The wire 18, which is skinned at its front end, is shown with a superimposed, unpressed end sleeve 19 in its frontal or heading inserting direction relative to the cheek plate 20.

Figure 5:
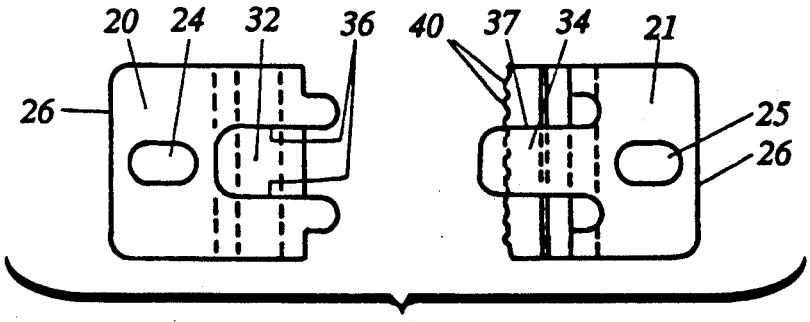
FIG. 5 shows a top view on the cheek plates.
Figure 6:
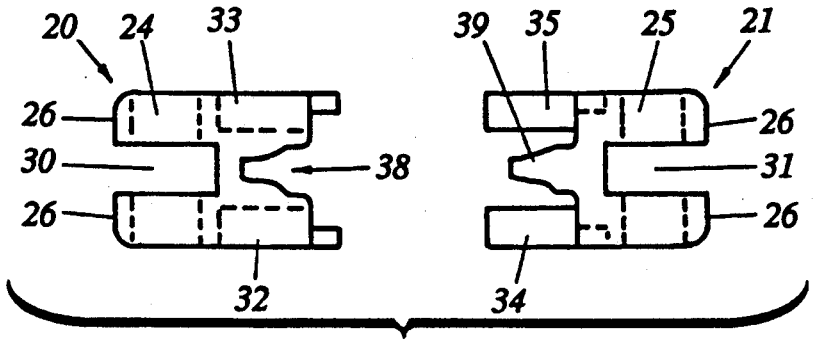
FIG. 6 shows a front view of the cheek plates.

In the FIGS. 5 and 6 the two cheek plates 20 and 21 are shown separately, namely in a disassembled condition, so that it is possible to recognize their shape. The cheek plate 20 comprises the oblong hole 24 for the penetration of bolt 22. On both sides in the large areas there are recesses 32 and 33, which are allocated to the projections 34 and 35 in the cheek plate 21. Between the recess 32 and the projection 34 there are guiding surfaces 36, whereas projection 34 is provided with the respective countersurfaces 37. The same applies to the recess 33 and the projection 35. In this way it is ensured that the cheek plates swivel about the bolts 22 and 23 in such a manner that the cheek plates themselves carry out a translational movement. The tilting or toeing in, which would lead to the conicalness of the end sleeve 19 to be pressed, is thus avoided. In the interior of the cheek plate 20 there is provided an axially continuous, matrix-shaped duct 38 and in the area of the cheek plate 21 there is provided a male mould 39, both matching one another with respect to their arrangement and both forming a trapezoidal cross section during the pressing of the end sleeves 19 for strands. The mould 39 carries toes 40 on its front side, said toes forming into the material of the end sleeve 19 along its trapezoidal side. It is to be recognized that the duct 38 and the mould 39 form the pressing position 17, in which the material of the end sleeve 19 is encompassed by nearly 360° and pressed.

Figure 7:
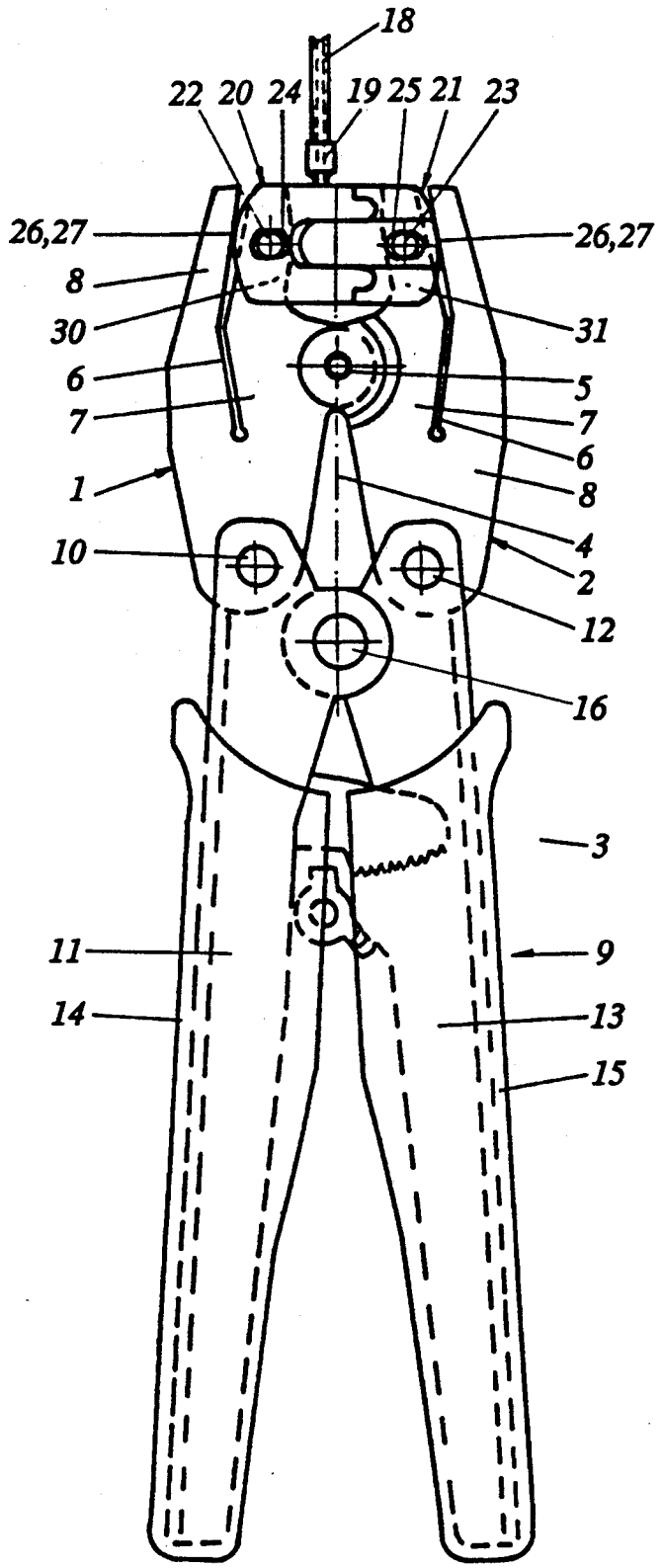
FIG. 7 shows the crimp tool in accordance with the FIGS. 1 to 5 in the pressing position with an end sleeve for strands in the middle cross-sectional range.
Figure 8:
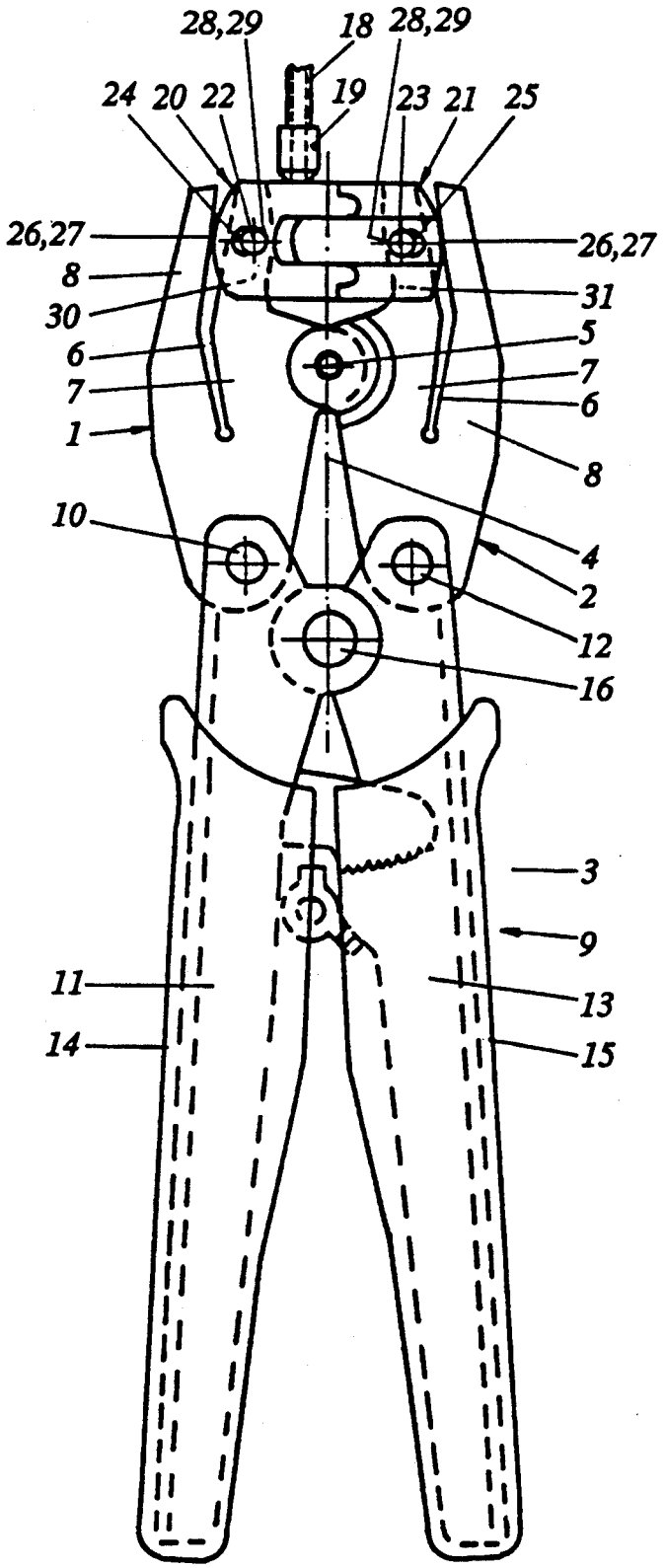
FIG. 8 shows the crimp tool in accordance with the FIGS. 1 to 5 in the pressing position with an end sleeve for strands in the maximum cross-sectional range.

The FIGS. 7 and 8 show the crimp tool in the closed position with an inserted wire comprising an end sleeve which is just being pressed. FIG. 7 shows the relative position of the components when a wire with a cross section of approx. 2 $mm^2$ is pressed. This constitutes a medium size in the lower third of the cross-sectional range. FIG. 8 on the other hand, shows the pressing position of a wire with a maximum cross section, i.e. a size within the magnitude of 6.0 $mm^2$.

FIG. 7 shows that the cheek plates 20 and 21 with their duct 38 and mould 39 have enclosed the end sleeve and the enclosed wire and are placed on said sleeve for the purpose of deforming it. By pressing the two handles 11 and 13 the required pressing force has been exerted, said pressing force being larger than the initial tension of the resilient areas 8. Said resilient areas have swollen even further with respect to the position in accordance with FIG. 2, so that the slots have become comparatively wider. No force is exerted on the cheek plates 20 or 21 via the rigid areas 7. Due to the comparatively further swelling of the resilient areas 8 the rigid areas 7 have slightly swivelled inwardly, so that the bolts 22 and 23 have covered a small path in the oblong holes 24 and 25, whereby, however, they are away from the two ends of the oblong holes.

FIG. 8 shows that the resilient areas 8 reach their maximum swelling when a wire with the maximum cross section is pressed. Slots 6 have their maximum width and the rigid areas 7 have such a relative position with respect to the cheek plates 20 and 21 that the bolts 22 and 23 with their counterstops 29 touch down on the second stops 28 at the end of the oblong holes 24 and 25. This allows exerting the additional force required for pressing wires with a maximum cross section through the rigid areas 7 onto the cheek plates 20 and 21. Naturally, the part of the pressing force also transmitted by the resilient areas 8 also acts in this condition. This partial force of the resilient areas 8 is, however, limited, because the swelling of the resilient areas 8 is limited. The jaws 1, 2 are thus protected from overstressing with respect to their resilient areas 8.

Figure 4:
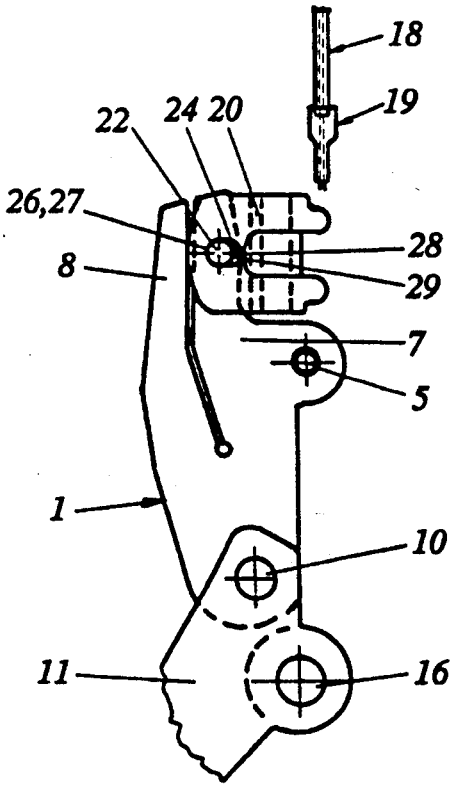
FIG. 4 shows a single view of a jaw with the respective cheek plate.
Figure 9:
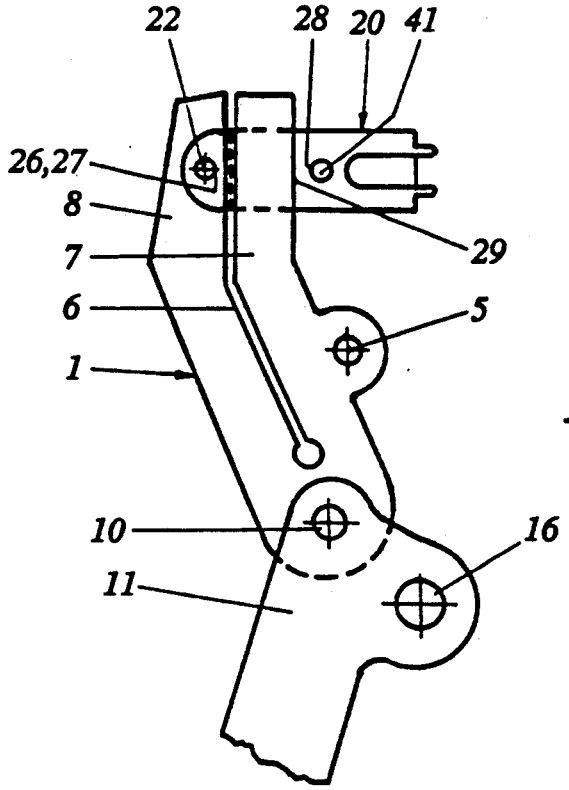
FIG. 9 shows a drawing outlining the principle containing a cheek plate suspended on the resilient part of the jaw and FIG. 10 shows a drawing outlining the principle containing an embodiment in which the rigid area of the jaw is arranged on the outside.

FIG. 9 shows a further embodiment of the crimp tool in a similar display as is shown in FIG. 4. Only jaw 1 is shown. The jaw 2 is arranged similarly. Jaw 1 is divided by slot 6 into the rigid area 7 and the resilient area 8. In contrast to the embodiments as described above, the pertinent cheek plate 20 is suspended by means of bolt 22 in the resilient area 8 of jaw 1, whereby cheek plate 20 may swivel about said bolt, but cannot be displaced in the longitudinal direction. Thus the first stop 26 and the first counterstop 27 are formed here in the vicinity of the bolt 22. The second stop 28 is provided by a nose 41, which can also be arranged as a projection in the cheek plate 20. The pertinent counterstop 29 is formed by the rigid area 7 of jaw 1. One can recognize that during the pressing in the substantial cross-sectional region with the exception of the maximum cross section the pressing forces are solely transmitted onto the cheek plates 20 and 21 via the resilient areas 8, whereby the stop 28 moves towards the stop 29 either more or less. When the maximum cross section of a wire is pressed there is no distance between stops 28 and 29. The resilient area 8 is subjected to a maximum swelling and an additional pressing force is transmitted through the rigid area 7.

Figure 10:
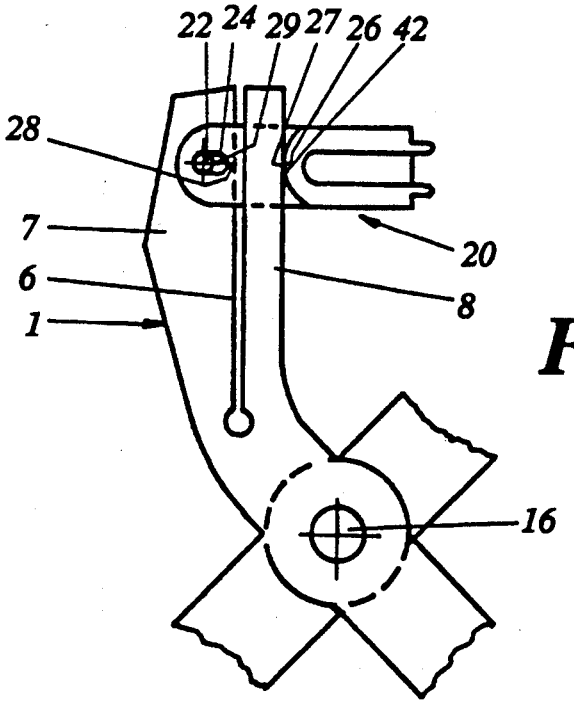

FIG. 10 shows an embodiment with a simple lever drive. In addition, the rigid area 7 and the resilient area 8 have changed their relative position, i.e. the resilient area is comparatively inside, so that the first stop 26 is formed by a projection 42 in the cheek plate 20. A counterstop 27 in the resilient area 8 is allocated to said first stop. The cheek plate 20 is suspended on the bolt 22. Said bolt is held in the rigid area 7 of the jaw 1. The cheek plate 20 comprises the oblong hole 24, so that in this embodiment the second stop 28 in the cheek plate 20 is formed by the outer end of the oblong hole 24, whereas, on the other hand, the bolt 22 forms the respective counterstop 29. It is possible, too, that the resilient area 8 sits close with an initial tension. It can be seen, however, that when wires of increasing cross sections are pressed, the width of slot 6 is reduced. The maximum swelling is limited here, too, by means of the second stop 28 and the second counterstop 29.

List of drawing references:

1=jaw
2=jaw
3=main extension plane
4=vertical median plane
5=axle journal
6=slot
7=rigid area
8=resilient area
9=drive
10=axle journal
11=handle
12=axle journal
13=handle
14=plastic coating
15=plastic coating
16=pivot journal
17=pressing position
18=wire
19=end sleeve
20=cheek plate
21=cheek plate
22=bolt
23=bolt
24=oblong hole
25=olbong hole
26=first stop
27=first counterstop
28=second stop
29=second counterstop
30=recess
31=recess
32=recess
33=recess
34=projection
35=projection
36=guiding surface
37=countersurface
38=duct
39=mould
40=toes
41=nose
42=projection

We claim:

1. A crimp tool for compressing the end sleeves of wire strands, comprising:

a pair of jaws, with each jaw including a driven end and a clamp end;

a pivot bearing connecting said jaws together intermediate their ends;

a drive attached to said driven end of each of said jaws for moving said clamp ends of said jaws between an open position and a closed position;

said jaws each including at its clamp end a rigid area and a resilient area movable with respect to said rigid area;

a pair of cheek plates, with each cheek plate moveably mounted to the clamp end of one of said jaws adjacent said rigid and resilient areas and movable with the movement of said jaws toward each other for engaging the end sleeves of wire strands, said cheek plates defining therebetween a pressing zone for compressing the end sleeves of wire strands;

a first stop and a counter-stop formed between each of said cheek plates and said resilient areas of said jaws and a second stop and counter-stop positioned between each of said cheek plates and said rigid areas of said jaws, with said first and second stops dimensioned with respect to their counter-stops such that said first stops are moved to engage their counter-stops during crimping and said second stops are moved to engage their counter-stops only during crimping of the end sleeves of wires having a maximum cross-sectional area to transmit an additional pressing force through said rigid areas without overstressing said jaws; and each resilient area of said jaws is formed as a spring jaw positioned adjacent said first stops so as to engage said first stops under exertion of an initial tension on said jaws.

2. The crimp tool of claim 1 and wherein each jaw is formed in one piece with said resilient areas and said rigid areas of said jaws formed by slots, each having an open end and each extending longitudinally along said jaws.

3. The crimp tool of claim 2 and wherein said slots each extend from a head end of each jaw adjacent said cheek plates beyond said pivot bearing.

4. The crimp tool of claim 1 and wherein each of said jaws further includes a series of plates forming a plate design thereon, and wherein said rigid areas are positioned interior of said resilient areas.

5. The crimp tool of claim 1 and wherein said cheek plates include oblong guide holes formed therein for guiding said cheek plates in said rigid areas of said jaws.

6. The crimp tool of claim 1 and wherein said drive comprises a pair of levers each attached at one end to one of said jaws.

7. The crimp tool of claim 1 and further including bolts extending transversely through a main extension plane for suspending and guiding said cheek plates together at said rigid areas, with said pressing position of said cheek plates arranged to enable frontal insertion of the end sleeves of the strands in the main extension plane.

8. The crimp tool of claim 1 and wherein said cheek plates are suspended in said resilient areas of said jaws.

9. The crimp tool of claim 1 and wherein said cheek plates comprise a profile adjacent said resilient areas such that the initial tension is exerted and increased only during closure of the crimp tool.

10. A crimp tool for compressing the end sleeves about wire strands, comprising:

a pair of jaws each having a clamp end and a driven end, with said clamp ends positioned in opposed relationship and movable toward and away from each other;

pivot means connecting said jaws together intermediate their ends;

drive means attached to said driven ends of said jaws for swiveling said clamp ends of said jaws about said pivot means;

a pair of cheek plates movably mounted to said clamp ends of said jaws and movable toward and away from each other in response to the movements of said clamp ends of said jaws and defining therebetween a pressing zone for compressing the end sleeves of wire strands, said clamp end of each jaw including a resilient portion and a rigid portion, said resilient portion being movable with respect to said rigid portion, wherein the resilient portion and the rigid portion of each jaw are formed by and separated by a slot formed in said clamp end of each jaw, with said resilient portion engageable with one of said cheek plates for urging its cheek plate toward said other cheek plate and yielding in response to a predetermined force being applied by said resilient portion against its cheek plate, and said rigid portion being engageable with its cheek plate in response to its resilient portion yielding a predetermined amount to urge its cheek plate toward said other cheek plate.

* * * * *